US006854519B2

(12) United States Patent
Deaton et al.

(10) Patent No.: US 6,854,519 B2
(45) Date of Patent: Feb. 15, 2005

(54) SUBSURFACE VALVE WITH SYSTEM AND METHOD FOR SEALING

(75) Inventors: Thomas Michael Deaton, Houston, TX (US); Winfield M. Sides, III, Bellaire, TX (US); Robert A. Jancha, Humble, TX (US); Roddie R. Smith, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/138,253

(22) Filed: May 3, 2002

(65) Prior Publication Data

US 2003/0205389 A1 Nov. 6, 2003

(51) Int. Cl.[7] ..... E21B 34/10; E21B 33/14

(52) U.S. Cl. ..... 166/374; 166/386; 166/334.1; 166/332.8

(58) Field of Search ..... 166/373, 374, 166/375, 381, 383, 386, 316, 319, 320, 332.1, 337.1, 332.8

(56) References Cited

U.S. PATENT DOCUMENTS

| | | | |
|---|---|---|---|
| 3,273,917 A | 9/1966 | Chakroff | 285/263 |
| 3,788,595 A | 1/1974 | Colonna | |
| 3,958,633 A | 5/1976 | Britch et al. | |
| 4,161,219 A | 7/1979 | Pringle | |
| 4,407,363 A | 10/1983 | Akkerman | |
| 4,467,870 A | 8/1984 | Langham | |
| 4,473,122 A | 9/1984 | Tamplen | |
| 4,493,373 A | 1/1985 | Jackson | |
| 4,495,998 A | 1/1985 | Pringle | |
| 4,503,913 A | 3/1985 | Carmody | |
| 4,527,630 A | 7/1985 | Pringle | 166/321 |
| 4,527,631 A | 7/1985 | Vazquez | |
| 4,569,397 A | 2/1986 | Brakhage, Jr. et al. | |
| 4,569,398 A | 2/1986 | Pringle | |
| 4,597,445 A | 7/1986 | Knox | |
| RE32,390 E | 4/1987 | Pringle | |
| 4,706,933 A | 11/1987 | Sukup et al. | |

(List continued on next page.)

FOREIGN PATENT DOCUMENTS

| | | |
|---|---|---|
| GB | 2 296 519 A | 7/1996 |
| GB | 2 323 872 A | 10/1998 |

OTHER PUBLICATIONS

PCT Search Report, International Application No. PCT/GB 03/01789, dated Feb. 19, 2004.

PCT Partial International Search Report, International Application No. PCT/GB 03/01789, dated Oct. 9, 2003.

*Primary Examiner*—David Bagnell
*Assistant Examiner*—Jennifer H Gay
(74) *Attorney, Agent, or Firm*—Moser, Patterson & Sheridan

(57) ABSTRACT

A valve for use in a wellbore, the valve having a compensating secondary sealing system for misalignments that inevitably occur in sealing subsurface valves, particularly subsurface safety valves. A sealing system can include a dynamic sealing system and a static sealing system, where the static sealing system establishes one or more line contact surfaces. The line contact surfaces can be leading, in that the forward edge of the seal faces a corresponding engagement portion of the actuator. The actuator can include at least two spherical engagement portions where one of the spherical engagement portions engages resilient and non-resilient seals with line contact surfaces on a downstroke and the other spherical engagement portion engages resilient and non-resilient seals with line contact surfaces on an upstroke. Further, a bearing disposed above seals on a piston of the actuator assists in keeping contaminants out of the seal area of the piston.

75 Claims, 9 Drawing Sheets

U.S. PATENT DOCUMENTS

| | | | | | |
|---|---|---|---|---|---|
| 4,716,969 | A | | 1/1988 | Pringle | |
| 4,838,355 | A | | 6/1989 | Leismer et al. | |
| 4,945,993 | A | | 8/1990 | Dickson et al. | |
| 4,951,753 | A | * | 8/1990 | Eriksen | 166/375 |
| 4,986,357 | A | | 1/1991 | Pringle | |
| 5,125,457 | A | | 6/1992 | Meaders | |
| 5,199,494 | A | | 4/1993 | Williamson, Jr. | |
| 5,251,702 | A | | 10/1993 | Vazquez | |
| 5,259,457 | A | | 11/1993 | Williamson, Jr. | |
| 5,263,847 | A | * | 11/1993 | Akkerman et al. | 251/303 |
| 5,284,205 | A | | 2/1994 | Smith | |
| 5,293,943 | A | | 3/1994 | Williamson, Jr. | |
| 5,310,004 | A | | 5/1994 | Leismer | |
| 5,411,096 | A | | 5/1995 | Akkerman | |
| 5,598,864 | A | | 2/1997 | Johnston et al. | |
| 5,862,864 | A | * | 1/1999 | Whiteford | 166/321 |
| 5,975,212 | A | | 11/1999 | Johnston | |
| 6,053,251 | A | | 4/2000 | Deaton | |
| 6,098,714 | A | * | 8/2000 | Deaton | 166/321 |
| 6,260,850 | B1 | * | 7/2001 | Beall et al. | 277/314 |
| 6,273,187 | B1 | | 8/2001 | Voisin, Jr. et al. | |
| 6,283,217 | B1 | | 9/2001 | Deaton | |
| 2002/0074129 | A1 | * | 6/2002 | Moore | 166/375 |

* cited by examiner

SUBSURFACE VALVE WITH SYSTEM AND METHOD FOR SEALING

FIELD OF THE INVENTION

This invention relates to the field of subsurface valves. More particularly, the invention relates to a subsurface safety valve and a method and system for sealing components of the subsurface safety valve.

BACKGROUND OF THE INVENTION

Subsurface safety valves are well known in the art. They are used in a well, such as an oil or gas well, to provide a safety shut off in the event of a well failure. A subsurface safety valve is typically mounted with other components, such as production tubing, and is set downhole in the well. The valve is typically a normally closed valve, in that the valve automatically shuts off under default conditions, such as with no power. When shut, the safety valve does not allow contents from below the safety valve, such as production fluids, to continue flowing to the surface of the well. Uncontrolled flowing production fluid, such as gas or other hydrocarbons, could cause explosions or otherwise damage the above-ground facilities in the event of a well failure.

Typically, a valve element, such as a disk-shaped "flapper", is used to seal off the production fluid in a main bore of the safety valve. The flapper is mounted to a hinge and can be pivoted to an open position to allow production fluid to flow. The flapper is forced open by a flow tube mounted in a bore of the subsurface safety valve. The flow tube slidably engages the flapper as the flow tube moves down the bore and pushes the flapper out of the main bore flow path. In many designs, an actuator having a piston in a side chamber adjacent the main bore is remotely actuated to cause the flow tube to move down to engage the flapper and force the flapper out of the flow path. A spring connected to the flow tube is commonly used separately or in conjunction with the piston to force the flow tube up to allow the flapper to enter and close off the main bore.

The challenge in a typical subsurface safety valve design is sealing. For example, seals that seal the piston as it travels up and down the side chamber can be exposed to debris and other well substances. The debris can cut or otherwise interfere with the seals. Further, the typical engagement of a piston to a flow tube can cause the piston to be nonuniformly loaded and cause misalignment of the piston. The misaligned piston can nonuniformly contact mating surfaces and reduce sealing effectiveness.

Some designs have attempted to correct this problem by supplementing the piston seals with secondary seals. As the piston reaches a maximum downward travel, a rod connected to the piston can be seated to help reduce the flow of debris and other leakage into the area that the piston would otherwise travel. Similarly, the piston or rod connected thereto can be sealed at an upward limit of the piston travel with an additional secondary seal. However, such secondary seals still encounter difficulties in effective sealing. These difficulties are also encountered in other types of subsurface valves, including without limitation, subsurface flow control valves and other downhole valves.

The field of subsurface valves is a mature art. Small, incremental improvements can make a substantial difference in performance. The present invention offers a solution to the above sealing ineffectiveness by providing an improved sealing system for the piston and associated members.

SUMMARY OF THE INVENTION

The present invention provides an incremental improvement in the well known art of subsurface valves for wells, and particularly, subsurface safety valves. The sealing system of the present invention provides a more compensating secondary sealing system for the misalignments that inevitably occur. The actuator includes a piston having a dynamic sealing system. The actuator also is statically sealed by a secondary sealing system establishing one or more line contact surfaces. In at least one embodiment, the line contact surfaces are leading, in that the forward edge of the seal is a line contact surface that faces a corresponding engagement portion of the actuator to which the actuator is first engaged. The engagement portion can be a spherical engagement portion to help maintain sealing effectiveness even with some misalignment. In some embodiments, the actuator includes at least two spherical engagement portions where one of the spherical engagement portions engages both a resilient seal and a non-resilient seal with line contact surfaces on a downstroke of the actuator and the other spherical engagement portion engages both a resilient seal and a non-resilient seal with line contact surfaces on an upstroke of the actuator. Further, a bearing disposed above seals on a piston of the actuator assists in keeping contaminants out of the seal area of the piston.

A subsurface safety valve system is provided, comprising a tubular body having a borehole formed therethrough, a valve member pivotably coupled to the tubular body to selectively close the borehole of the subsurface safety valve, a tubular member at least partially disposed in the borehole and slidably coupled with the tubular body, the tubular member adapted to selectively displace the valve member in the borehole, the safety valve further having a chamber formed therein with at least one chamber wall, the chamber coupled to the borehole, the chamber having at least one fluid port for connecting to a fluid source, an actuator slidably mounted within the chamber to establish a stroke and coupled to the tubular member in the borehole, the actuator having an engagement portion, and a leading, annular, line contact surface facing the actuator engagement portion and adapted to seat the engagement portion at a selected portion of the actuator stroke.

Another embodiment is provided for a subsurface safety valve, comprising a tubular body having a borehole formed therethrough, a valve member pivotably coupled to the tubular body to selectively close the borehole of the subsurface safety valve, a tubular member at least partially disposed in the borehole and slidably coupled with the tubular body, the tubular member adapted to selectively displace the valve member in the borehole, the safety valve further having a chamber formed therein with at least one chamber wall, the chamber coupled to the borehole, the chamber having at least one fluid port for connecting to a fluid source, an annular line contact surface disposed in the chamber, and an actuator slidably mounted within the chamber to establish a stroke and coupled to the tubular member in the borehole, the actuator having a spherical engagement portion adapted to seat against the annular line contact surface at a predetermined position of the stroke.

The invention further provides a subsurface safety valve system, comprising a tubular body having a borehole formed therethrough, a valve member pivotably coupled to the tubular body to selectively close the borehole of the subsurface safety valve, a tubular member at least partially disposed in the borehole and slidably coupled with the tubular body, the tubular member adapted to selectively displace the valve member in the borehole, the safety valve further having a chamber formed therein with at least one chamber wall, the chamber coupled to the borehole, the chamber having at least one fluid port for connecting to a fluid source, a two annular line contact surfaces disposed in the chamber, and an actuator slidably mounted within the chamber to establish a stroke and coupled to the tubular member in the borehole, the actuator having an engagement portion adapted to seat against both of the annular line contact surfaces at a predetermined position of the stroke.

Another embodiment of a subsurface safety valve system is provided, comprising a tubular body having a borehole formed therethrough, a valve member pivotably coupled to the tubular body to selectively close the borehole of the subsurface safety valve, a tubular member at least partially disposed in the borehole and slidably coupled with the tubular body, the tubular member adapted to selectively displace the valve member in the borehole, the safety valve further having a chamber formed therein with at least one chamber wall, the chamber coupled to the borehole, the chamber having at least one fluid port for connecting to a fluid source, two annular line contact surfaces disposed in the chamber, and an actuator slidably mounted within the chamber to establish a stroke and coupled to the tubular member in the borehole, the actuator having a spherical engagement portion adapted to seat against both of the annular line contact surfaces at a predetermined position of the stroke.

Yet another embodiment of the subsurface safety valve system is provided, comprising a tubular body having a borehole formed therethrough, a valve member pivotably coupled to the tubular body to selectively close the borehole of the subsurface safety valve, a tubular member at least partially disposed in the borehole and slidably coupled with the tubular body, the tubular member adapted to selectively displace the valve member in the borehole, the safety valve further having a chamber formed therein with at least one chamber wall, the chamber coupled to the borehole, the chamber having at least one fluid port for connecting to a fluid source, an actuator slidably mounted within the chamber to establish a stroke and coupled to the tubular member in the borehole, the actuator having an engagement portion, and an annular stop seal cartridge removably coupled to the chamber, the stop seal cartridge comprising a resilient seal establishing an annular line contact surface and a non-resilient seal establishing a second annular line contact surface, the actuator being adapted to engage at least one of the line contact surfaces.

The invention also provides a method of sealing a subsurface safety valve, comprising providing a subsurface safety valve having a tubular body with a borehole formed therethrough and a valve element pivotably coupled to the tubular body to selectively close the borehole, allowing the valve element to be pivoted open by actuating a tubular member coupled to the valve element with an actuator slidably mounted in an adjacent chamber, the actuator comprising an engagement portion, and statically sealing the actuator against a leading, annular, line contact surface facing the actuator engagement portion.

In a further embodiment, a method of sealing a subsurface safety valve is provided, comprising providing a subsurface safety valve having a tubular body with a borehole formed therethrough and a valve element pivotably coupled to the tubular body to selectively close the borehole, allowing the valve element to be pivoted open by actuating a tubular member coupled to the valve element with an actuator slidably mounted in an adjacent chamber, and statically sealing the actuator with a spherical engagement portion against an annular line contact surface.

Another embodiment is a method of sealing a subsurface safety valve, comprising providing a subsurface safety valve having a tubular body with a borehole formed therethrough and a valve element pivotably coupled to the tubular body to selectively close the borehole, allowing the valve element to be pivoted open by actuating a tubular member coupled to the valve element with an actuator slidably mounted in an adjacent chamber, and statically sealing the actuator against two annular line contact surfaces.

A further embodiment of the present invention is a subsurface safety valve system, comprising a tubular body having a borehole formed therethrough, a valve member pivotably coupled to the tubular body to selectively close the borehole of the subsurface safety valve, a tubular member at least partially disposed in the borehole and slidably coupled with the tubular body, the tubular member adapted to selectively displace the valve member in the borehole, the safety valve further having a chamber formed therein with at least one chamber wall, the chamber coupled to the borehole, the chamber having at least one fluid port for coupling to a fluid source, an actuator slidably mounted within the chamber to establish a stroke and coupled to the tubular member in the borehole, the actuator having an engagement portion and a piston, one or more seals coupled to the piston and disposed at least partially between the piston and the chamber wall, and a bearing coupled to the actuator and slidable with the actuator in the chamber, the bearing disposed at least partially between the actuator and the chamber wall and between one or more of the seals and the fluid port.

Another embodiment is a subsurface valve sealing system, the subsurface valve including a tubular body with a borehole formed therethrough, a tubular member slidably coupled with the tubular body, a chamber formed in the tubular body and having at least one chamber wall, the chamber coupled to the borehole and having at least one fluid port for connecting to a fluid source, and an actuator slidably mounted within the chamber to establish a stroke and coupled to the tubular member in the borehole, the actuator having an engagement portion, the system comprising an annular stop seal cartridge removably coupled to the chamber, the stop seal cartridge comprising a resilient seal establishing an annular line contact surface and a non-resilient seal establishing a second annular line contact surface, the stop seal cartridge adapted to be engaged with the actuator engagement portion at at least one of the line contact surfaces.

In another embodiment, a method of sealing a subsurface safety valve is provided, comprising providing a subsurface safety valve having a tubular body with a borehole formed therethrough and a valve element pivotably coupled to the tubular body to selectively close the borehole, allowing the valve element to be pivoted open by actuating a tubular member coupled to the valve element with an actuator slidably mounted in an adjacent chamber and having an engagement portion, at least partially sealing a portion of the actuator against a chamber wall with one or more seals coupled to the actuator and disposed around the actuator, and restricting a flow of contaminants from a fluid source to one or more of the seals as the actuator moves in the chamber by providing a bearing slidably coupled with the actuator in the chamber and disposed between the fluid source and one or more of the seals.

BRIEF DESCRIPTION OF THE DRAWINGS

A more particular description of the invention, briefly summarized above, can be realized by reference to the embodiments thereof that are illustrated in the appended drawings and described herein. However, it is to be noted that the appended drawings illustrate only some embodiments of the invention. Therefore, the drawings are not to be considered limiting of its scope, for the invention may admit to other equally effective embodiments.

DETAILED DESCRIPTION OF THE INVENTION

Figure 1:
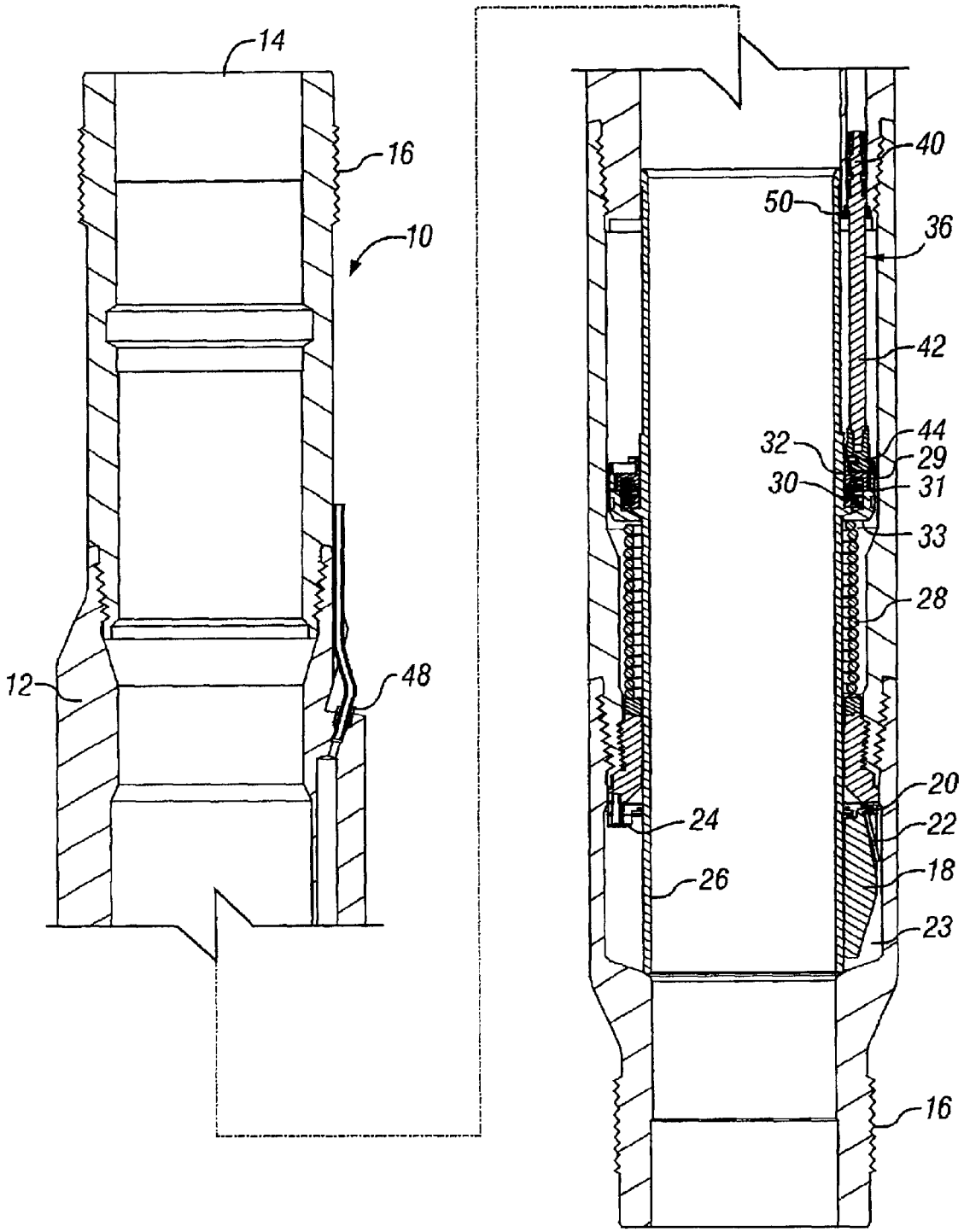
FIG. 1 is a schematic cross-sectional side view of a subsurface safety valve in an open position with an actuator in contact with a down-stop seal assembly.
Figure 2:
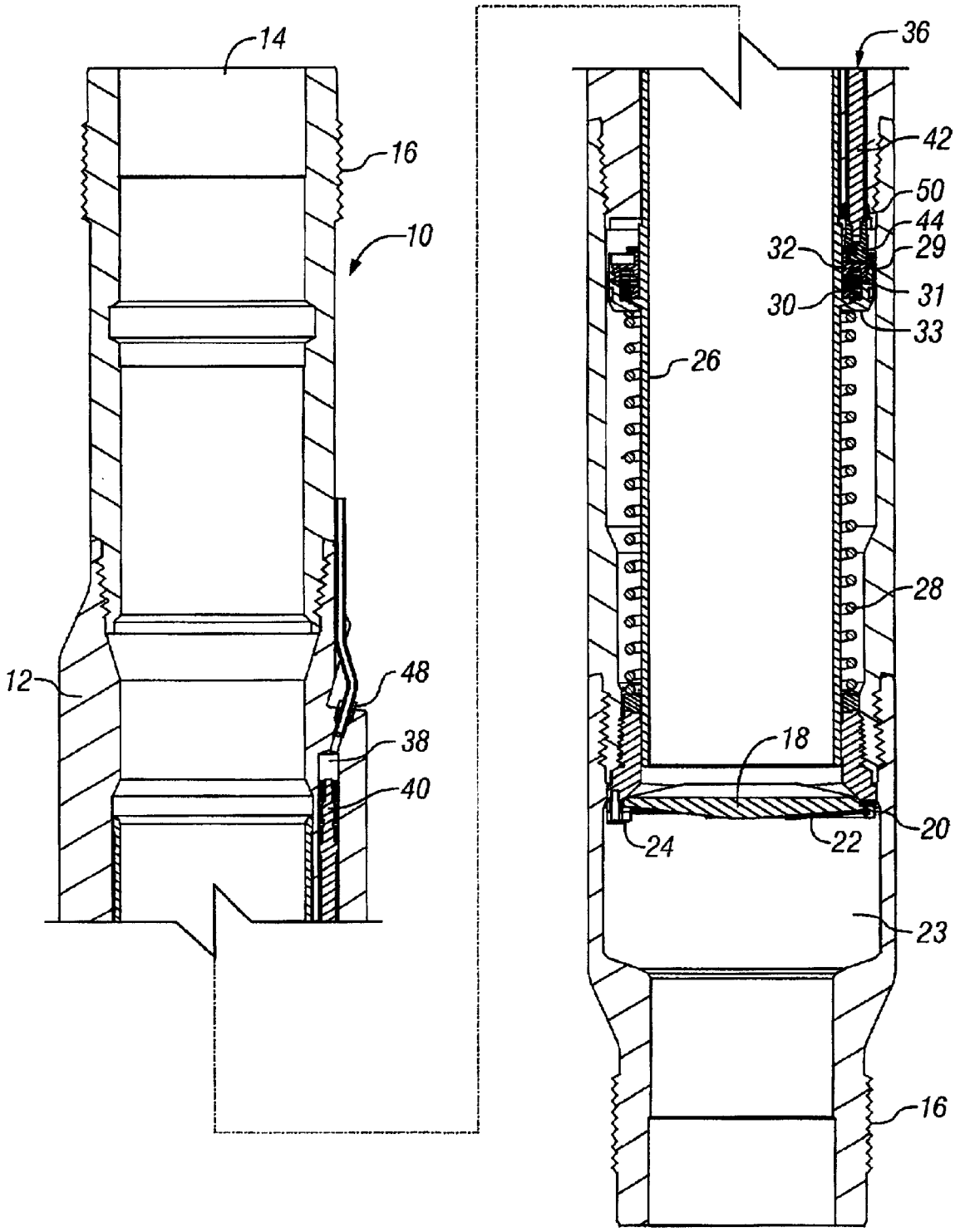
FIG. 2 is a partial schematic cross-sectional view of the subsurface safety valve in a closed position with the actuator in contact with an up-stop seal assembly.

FIG. 1 is a schematic cross-sectional side view of a subsurface safety valve in an open position with an actuator in contact with a down-stop seal assembly. FIG. 2 is a partial schematic cross-sectional view of the subsurface safety valve in a closed position with the actuator in contact with an up-stop seal assembly. FIGS. 1 and 2 will be described in conjunction with each other and similar elements are numbered similarly.

A subsurface safety valve 10 generally includes a tubular body 12 having one or more portions coupled thereto. The tubular body 12 includes a borehole 14 through which fluids, such as well production fluids, can pass. Generally, each end of the tubular body 12 has one or more types of fasteners 16, such as threads, locking lugs, and other elements to couple adjacent members together, such as a pipe section in a well bore (not shown). The term "coupled," "coupling," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include integrally forming one functional member with another. The coupling can occur in any direction, including rotationally.

The subsurface safety valve 10 includes a valve element 18 that is used to selectively close the borehole 14. The valve element 18 can be a disk-shaped structure and will be referred to hereinafter as a flapper 18, although other configurations are possible, such as ball elements and other types as would be known to those with ordinary skill in the art, and are included within such term. The flapper 18 can seal substantially all of the borehole 14 when rotated into position. The flapper 18 pivots about a pivot member 20, such as a hinge. The flapper 18 is generally biased to a closed position across the borehole 14 and can use a bias member 22, such as a spring, to assist in establishing the normally closed position. In at least one embodiment, the flapper 18 can be pivoted back into a recess 23 formed in the tubular body 12 to allow less restrictive flow through the borehole 14. In a closed position, described more fully in reference to FIG. 2, the flapper 18 generally engages an annular flapper seat 24. Generally, pressure is greater below the flapper 18 compared to above the flapper. Thus, pressure exerted on the lower surface of a closed flapper 18 helps seal the flapper 18 against the annular flapper seat 24.

A tubular member, such as a flow tube 26, can be slidably mounted within the tubular body 12. The terms "tubular member" and "flow tube" are used broadly herein and are meant to include a longitudinal member, whether whole or segmented, that encompasses at least a portion of a periphery of the borehole 14 in the tubular body 12 and can be located inside, on, or outside the borehole periphery. In the orientation shown in FIG. 1, the flow tube 26 is disposed in a downward position, so that it engages the flapper 18 to push the flapper out of a flow path of the borehole 14. In the orientation shown in FIG. 2, the flow tube 26 is disposed in an upward position, so that it allows the flapper 18 to close against the flapper seat 24 across the flow path to block any flow through the borehole.

In at least one embodiment, the flow tube 26 is biased away from the flapper 18 by a bias member 28. Generally, the bias member 28 includes a spring that annularly surrounds the flow tube 26. However, it is to be understood that any type of member that can apply a bias to another element is within the scope of the term "bias member" used herein. In at least one embodiment, the bias member 28 is positioned so that it displaces the flow tube 26 away from the flapper 18. For example, in the orientation shown in FIG. 1, the bias member 28 pushes the flow tube 26 upwardly and away from the flapper 18 mounted thereunder.

An actuator 36 can be used to control the movement of the flow tube 26 in conjunction with the bias member 28 or in opposition to the bias member 28. In at least one embodiment, the actuator 36 can be disposed in a chamber 38 that is coupled to the tubular body 12. Chamber 38 can be an annular chamber in the tubular body, for example, if the actuator 36 is a cylindrical flow tube. Alternatively, the actuator 36 can be one or more discrete longitudinal members that do not circumscribe the entire tubular body 12. For example, an actuator 36 could be disposed in a chamber 38 at a certain portion of the periphery of the flow tube 24. Although only one actuator 36 in chamber 38 is shown, it is to be understood that a plurality of actuators/chambers can be used.

The actuator 36 disposed in the chamber 38 can include a piston 40 and a rod 42 coupled thereto. The piston and rod can be formed integrally or otherwise coupled in some manner. The piston 40 generally includes one or more dynamic seal systems 51 described more fully in reference to FIG. 3. The dynamic seal systems 51 help seal the piston 40 in the chamber 38 as the piston moves up and down in the chamber. The movement of the actuator 36 in the chamber 38 is termed herein a "stroke." A movement in the upward direction is termed an "upstroke" and movement in the down direction is termed a "downstroke" in the orientations shown relative to the figures. Other orientations and arrangements are contemplated by the present invention and the above orientation and arrangement is exemplary.

The rod 42 can extend longitudinally down the chamber 38 and be coupled to the flow tube 26. In at least one embodiment, the rod 42 can include a lip 44. The lip 44 can engage a flange 32. The engagement can have a sufficient clearance to allow the parts to move independently as far as the clearance will allow, as explained below. A retainer 29 can be coupled to the flow tube 26. The flange 32 is coupled to the retainer 29, so that the rod 42 moves in substantial association with the flow tube 26. The flow tube 26, retainer 29, and flange 32 can form a buffer volume 30. A bias element 31 can be disposed in the buffer volume 30. The retainer 29 helps retain the flange 44 in position against the flange 32 and retain the bias element 31 in the buffer volume.

The bias element 31 in the buffer volume 30 and the clearance formed between the lip 44 and the flange 32 allow the flow tube 26 to seat on a portion of the wall of the borehole 14 while also allowing the actuator to move within the amount of the clearance to independently seat on one or more seals of the stop seal cartridge 50. The clearance allows for tolerances created during the manufacturing process.

The bias member 28 can bias the retainer 29 and the flow tube 26 coupled thereto by engaging a portion 33 of the retainer 29 below the buffer volume 30. Naturally, other arrangements could be made and the above configuration is an exemplary, non limiting arrangement as would be known to those with ordinary skill in the art.

A port 48 can be formed in the subsurface safety valve 10 to allow fluid to enter the chamber 38. For example, fluid from a surface source (not shown) can enter the chamber 38 and sufficiently pressurize the chamber to cause the piston 40 to move in the chamber 38.

A stop seal cartridge 50 as a secondary sealing system can also be included in the present invention. The cartridge assembly 50 acts as a static sealing system in conjunction with the actuator 36. The piston 40 and/or rod 42 generally includes a surface, termed an engagement portion, that can engage one or more annular seals in the cartridge assembly at some position in the upward and downward movements of the actuator 36. The annular seals can provide additional sealing for the actuator 36 when the actuator 36 is in a stationary position. For example, when the actuator 36 is in a downward position so that the flapper 18 is open, then the actuator 36 can be seated against one or more seals in the stop seal cartridge 50. Likewise, when the actuator 36 is in an upward position so that the flapper is allowed to close, the actuator 36 can seat against another set of one or more seals in the cartridge assembly. The seal arrangement can be essentially bi-directional. In at least one embodiment, the use of the seals in the stop seal cartridge 50 can restrict the length of the stroke of the actuator 36. Further details of the seals and the stop seal cartridge 50 are disclosed in reference to FIGS. 4 and 5.

In operation, the subsurface safety valve 10 is mounted downhole in a tubular arrangement. In a normal condition, the flapper 18 is pivoted across the borehole 14 and seals off portions of the well below the flapper 18. In that position, the bias member 28 applies a bias upwardly to the flow tube 26, so that the flow tube allows the flapper 18 to engage the seat 24. Further, the actuator 36 also engages a seal, such as one disposed in the cartridge assembly 50, on an upstroke of the actuator to assist in statically sealing the chamber 38 to help protect the piston 40 from debris and other contaminants.

A fluid is applied to the chamber 38 through the port 48. The fluid exerts a force on the piston 40 to cause a downstroke and pushes the actuator 36 down against the bias member 28, so that the flow tube 26 is lowered. The flow tube 26 then forces the flapper 18 away from the flapper seat 24 and into a retracted position against the periphery of the borehole 14 and into the recess 23. Thus, the borehole is opened as the flapper rotates away from the seat 24. On the downstroke, the actuator engages another seal, such as one disposed in the cartridge 50, and seats against the seal to provide protection for the chamber 38 and actuator 36 disposed above the seal.

Figure 3:
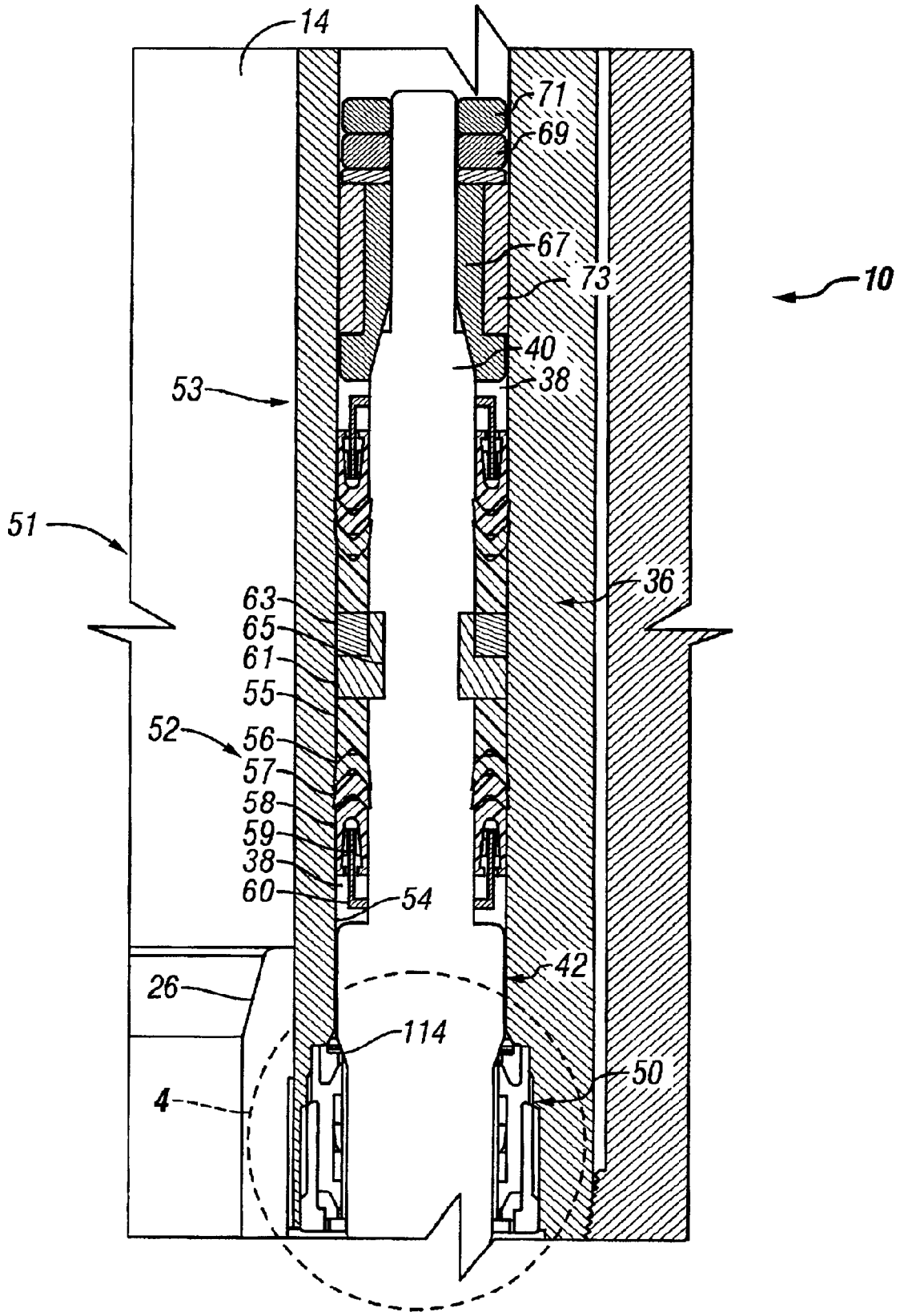
FIG. 3 is a partial schematic cross-sectional view of the actuator and a first sealing system related thereto.

FIG. 3 is a partial schematic cross-sectional view of the actuator and a dynamic sealing system 51. Similar elements of FIGS. 1 and 2 are similarly numbered throughout this and other figures. In at least one embodiment, the actuator comprises a piston 40 and a rod 42. The piston 40 moves up and down in the chamber 38.

The dynamic sealing system 51 generally surrounds the periphery of the piston 40. The dynamic sealing system 51 slidably engages a chamber wall 54 of the chamber 38 as the piston reciprocates or otherwise moves up and down. The dynamic sealing system 51 can include a lower portion 52 and an upper portion 53. Generally, the upper and lower portions are similar and for purposes of illustration the lower portion 52 will be principally described.

A seal support 55 is disposed substantially in the vertical middle of the sealing system 51. The seal support 55 can be shaped a variety of ways to offer shaped support for subsequent seals. One or more seals 56, 57 are disposed downward from the seal support 55. In at least one embodiment, the seals can be shaped to flare out and seal against chamber wall 54 when fluidic or mechanical force is applied thereto. A seal 58 can be disposed downward from the seals 56, 57. Generally, the seal 58 will be formed from a less resilient material than seals 56, 57. To assist the sealing of the seal 58, a bias member 59 can be inserted into a cavity of the seal 58 to help engagement portions of the seal flare out to effect better sealing. A cushion 60 can also be coupled to one or more of the seals in the lower portion 52 and extend downward to help avoid damage to the seals in the case of overtravel and impact against an adjoining surface.

The upper portion 53 is similarly arranged as the lower portion 52. The upper portion can include the seal support 55, one or more seals 56, 57, seal 58, bias member 59, cushion 60, and other members described herein. The orientation of the members can be reversed from an downward orientation to an upward orientation.

On the upstroke and downstroke of the actuator 36, the lower portion 52 and upper portion 53 can experience significantly different pressure regimes. A thrust ring 61 can be used to block a force caused by pressure on one of the lower or upper portions from the other portion. The thrust ring 61 is generally disposed in a groove 65 formed in the piston 40. Whenever pressure on the lower portion would otherwise force the lower portion into the upper portion or vice versa, the thrust ring 61 helps block such interaction. In some embodiments, a second thrust ring 63 can be coupled with the thrust ring 61 to further block the force between the lower portion and upper portion.

The upward end of the dynamic sealing assembly 51 can include a seal retainer 67 to hold the various seals and associated parts in relative proximity to the piston 40. One or more fasteners 69, 71 can be used to fasten the retainer to the piston.

A bearing 73 is coupled to the piston 40 and can be disposed between the piston and the chamber wall 54. The bearing is slidably engaged with the chamber wall 54 in conjunction with movement of the piston 40 and can assist in alignment as the piston moves up and down. In one embodiment, the bearing 73 can be disposed outward from at least a portion of the retainer seal 67 in a recess formed therein.

Further, the bearing 73 is generally disposed above the dynamic sealing system 51, that is, between the sealing system 51 and some source of fluid used to actuate the piston, such as port 48 that is shown in FIGS. 1–2. In this position, the bearing 73 can also function to restrict particulates and other contaminants entering the chamber 38. The bearing 73 can thus at least partially protect the dynamic sealing system 51.

Figure 4:
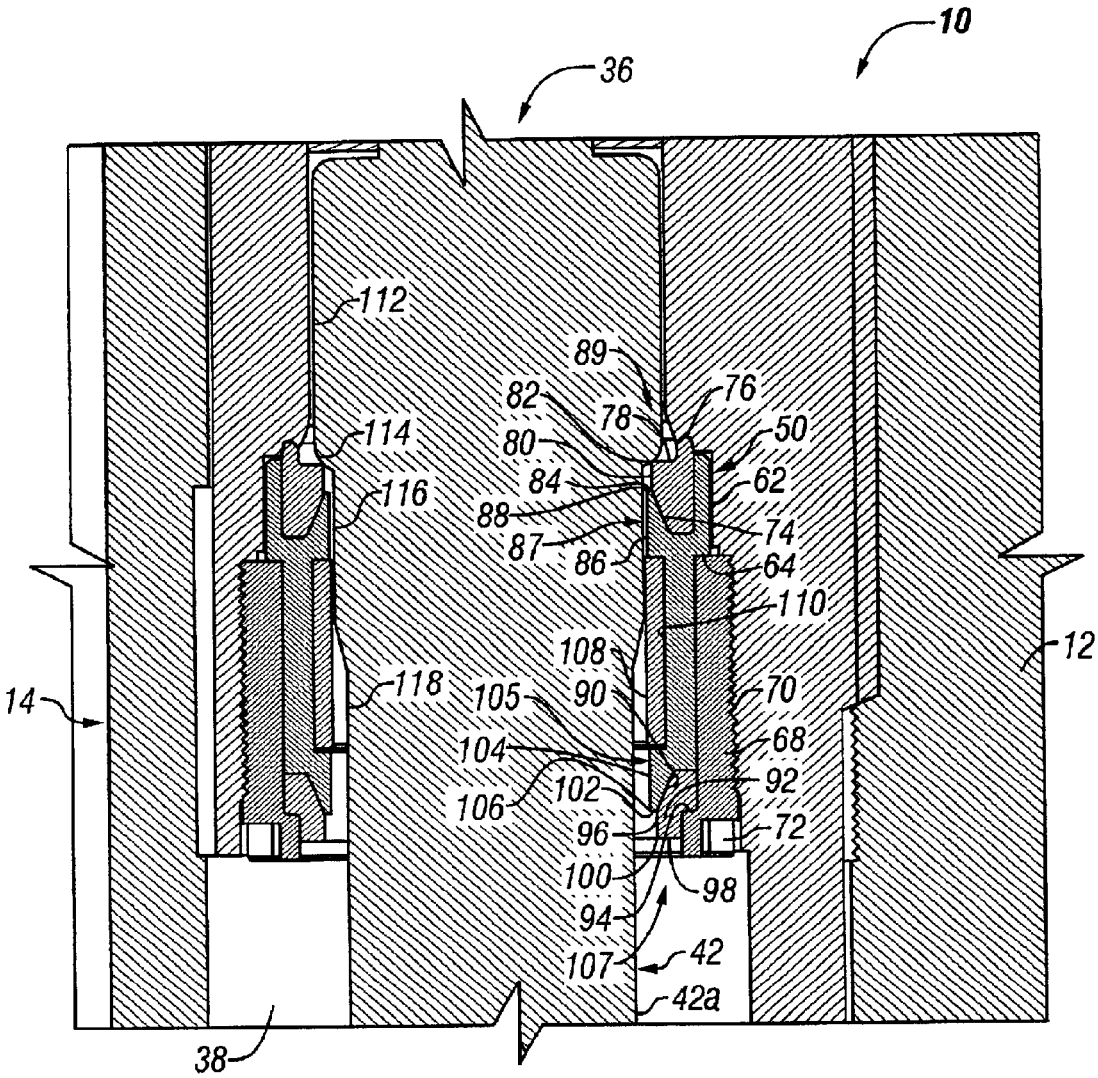
FIG. 4 is a partial schematic cross-sectional view of the actuator and a down-stop seal assembly of the present invention.
Figure 4A:
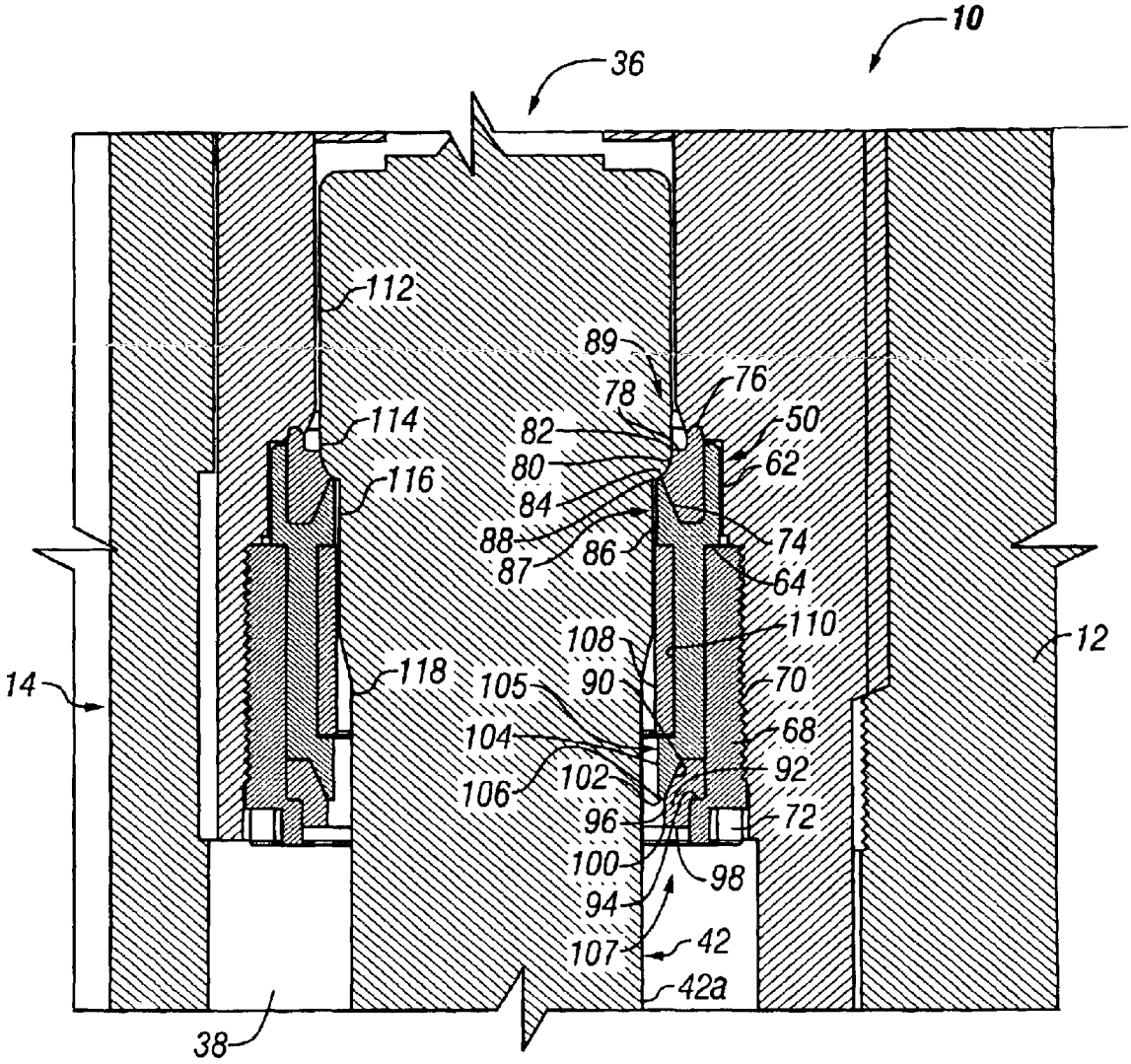
FIG. 4*a* is a partial schematic view similar to FIG. 4, where the actuator is shown in a fully engaged position with the down-stop assembly.

FIG. 4 is a partial schematic cross-sectional view of the actuator and a down-stop seal assembly of the present invention, where the actuator is shown in a partially engaged position at least one line contact surface. FIG. 4*a* is a partial schematic view similar to FIG. 4, where the actuator is shown in a fully engage position with at least two line contact surfaces. FIGS. 4 and 4*a* will be described in conjunction with one another. The actuator 36 is shown in an engaged position with the stop seal cartridge 50. Details of one embodiment of the stop seal cartridge 50 will be described below. Variations in keeping with the scope of the invention can be made that would be apparent to those with ordinary skill in the art.

The stop seal cartridge 50 can include a housing 62. The housing 62 is generally a metallic body, although other materials can be used, including non-resilient materials. The term "non-resilient" is used broadly herein to include materials that are substantially non-deformable under standard operating conditions. For example and without limitation, such materials could include various metals, plastics and other polymeric compounds, composites, fiber reinforced materials, and other rigid materials known to those with ordinary skill in the art.

A groove 74 can be formed in the housing 62. A resilient seal 76 is generally disposed in the groove 74 to seal against the actuator 36. The resilient seal 76 includes a shoulder 78 and an inner wall 80. The shoulder 78 and inner wall 80 intersect at a generally non-beveled line to establish an annular line contact surface 82. The line contact surface 82 allows for some misalignment of the actuator 36 and still effect a sealing engagement.

Advantageously, the present invention provides that at least one seal establishes a leading annular line contact surface. By the term "leading," the annular line contact surface is the forward most portion of the seal that the engagement portion will engage and faces the respective engagement portion of the actuator. This arrangement is in contrast to a trailing bevel, among other arrangements, found in prior efforts. A leading annular line contact surface ensures that the engagement portion of the actuator will contact the annular line contact surface substantially around the entire periphery of the seal, especially in case of misalignment as described below.

The housing 62 can also include a shoulder 84 disposed toward the center of the housing and an inner wall 86 of the housing. The shoulder 84 and inner wall 86 intersect at a generally non-beveled point to effectively establish seal 87 having an annular second line contact surface 88. In other embodiments, the seal 87 with the annular second line contact surface 88 could be formed from a separate element coupled to the housing 62 or other portions of the tubular body 12 or cartridge 50.

The second line contact surface 88 generally has a larger annular diameter than the line contact surface 82. The actuator 36 is generally dimensioned to contact both line contact surfaces 82, 88 in a lowered, downstroke position. If the housing 62 is a non-resilient member, such as a metallic member, then the actuator 36 can contact both line contact surfaces with one being a resilient line contact surface and the other being a non-resilient line contact surface, such as a metallic line contact surface. At least one of the line contact surfaces 82, 88, and advantageously both line contact surfaces, form a "down-stop seal assembly" 89.

Further, the stop seal cartridge 50 includes a centralizer bushing 108 in at least one embodiment. The centralizer bushing 108 can be disposed in a recess 110 formed in the housing 62. The centralizer bushing 108 helps ensure the alignment of the actuator 36 as it engages the down-stop seal assembly 89 and the line contact surfaces 82, 88.

The housing 62 can include a mounting surface 90. A resilient seal 92 can be disposed circumferentially around the mounting surface 90. The subhousing 68 can include a shoulder 94 that when assembled abuts the resilient seal 92 and holds it in position against the mounting surface 90.

The resilient seal 92 can include a shoulder 98 and an inner wall 96 that intersect to form an annular line contact surface 100. In a similar fashion, the housing 62 can include a shoulder 102 and an inner wall 104, which can intersect to effectively form a seal 105 establishing a second annular line contact surface 106. In other embodiments, the seal 105 with the annular second line contact surface 106 could be formed from a separate element coupled to the housing 62 or other portions of the tubular body 12 or cartridge 50. Advantageously, at least one seal establishes a leading annular line contact surface.

One or more of the line contact surfaces 100, 106 form a sealing engagement with the actuator 36 when the actuator is in a raised position on the actuator upstroke. At least one of the annular line contact surfaces 100, 106 and preferably both line contact surfaces form an "up-stop seal assembly" 107. Further details of the up-stop seal assembly are described in reference to FIG. 5.

The stop seal cartridge 50 can also include a subhousing 68. The subhousing 68 can be separated from the housing 62 so that various elements, such as seals, can be inserted therebetween. The subhousing 68 can be engaged with the tubular body 12 or subpart thereof through a fastener 70, such as threads. A rotation member 72 formed or otherwise coupled to the subhousing 68 can be used to help rotate the subhousing 68 into an engagement or disengagement position in the tubular body 12 or subpart thereof. Further, the subhousing 68 can assist in retaining the housing 62 in position with tubular body 12. For example, the subhousing 68 can engage a shoulder 64 formed on the housing 62, so that the housing 62 is suitably retained.

Generally, one or more engagement portions can be formed in or otherwise coupled to the actuator 36 to form a mating surface to the annular line contact surfaces generally disposed in the stop seal cartridge 50. For example, the actuator 36 can include a first diameter 112 that generally has the dimensions of the cross-sectional area of chamber 38 less applicable clearances. The term "diameter" is used broadly herein and is intended to include one or more cross sectional dimensions across a member regardless of its concentricity, including without limitation, round, elliptical, square, rectangular, annular, and other shapes.

The first diameter 112 can be reduced in dimension to form a first engagement portion 114 for sealing against one or more of the annular line contact surfaces. The first engagement portion 114 can be shaped as a spherical surface. The spherical surface offers a distinct advantage over other configurations by allowing the spherical shape to fully engage at least one of the annular line contact surfaces regardless of misalignments. This spherical feature contrasts with bevels and other configurations known in the art, since a spherical surface has only line contact. Thus, the spherical surface of the present invention can engage one or more of the line contact surfaces of the seal cartridge 50 in effectively sealing the chamber 38.

The spherical first engagement portion 114 can reduce to a second diameter 116. The second diameter 116 can be sized to about the same diameter as the centralizer bushing 108 less applicable clearances to help ensure alignment of the actuator 36 with the annular line contact surfaces, such as in the stop seal cartridge 50.

The diameter 116 can be reduced to a third diameter 118 that forms the "running" diameter of the rod 42 portion of the actuator 36 in the chamber 38. The diameter 118 is dimensioned so as to not interfere with the centralizer bushing 108.

Referring to FIG. 1 in conjunction with FIG. 4, the operation of the actuator 36 in conjunction with the down-stop seal assembly can be illustrated. When the actuator 36 is lowered in a downstroke, the flow tube 26 pivots the flapper 18 away from a restricting orientation in the borehole 14. The actuator 36 is then in a static down position. During normal operation, the actuator 36 stays in that position. The down-stop seal assembly can be positioned so that the first spherical engagement portion 114 of the actuator 36 in the down position engages the down-stop seal assembly 89. The centralizer bushing 108 assists in centering the actuator 36 so that a concentric and more uniform seal occurs. However, the combination of the spherical first engagement portion 114 and one or more of the line contact surfaces 82, 88, alone or in combination, allow for some misalignment while effecting a continuous seal about the periphery of the actuator 36.

Advantageously, the spherical first engagement portion 114 is designed to contact both annular line contact surfaces 82, 88 when fully engaged in a down-stop position. Generally, the first engagement portion 114 will contact the resilient seal 76 with a resilient line contact surface and deflect it outwardly as the first engagement portion 114 continues its travel to the second line contact surface 88 and stops. When the actuator is disengaged by upward movement in an upstroke, the first engagement portion 114 disengages from the second line contact surface 88 and then the line contact surface 82.

Figure 5:
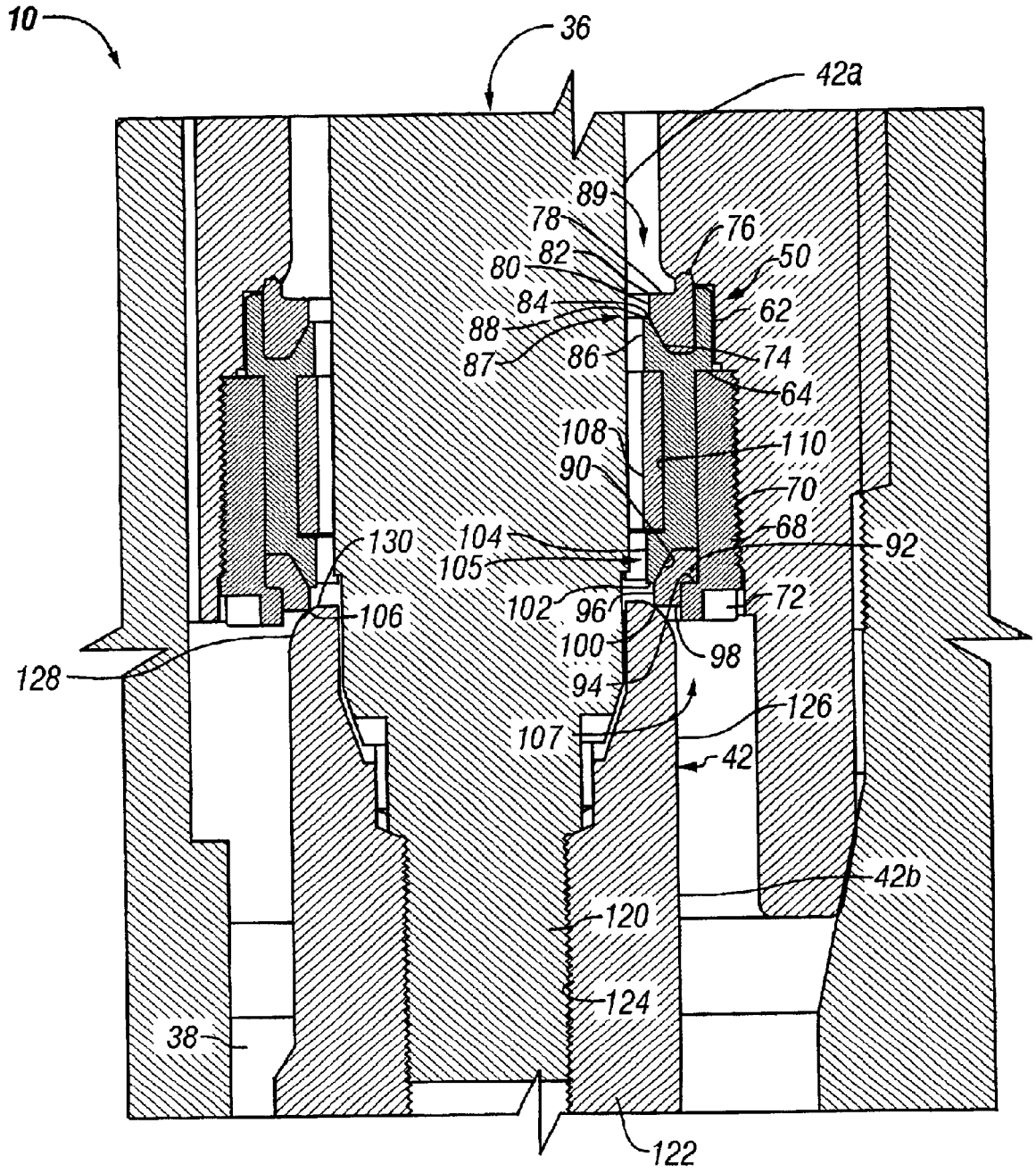
FIG. 5 is a partial schematic cross-sectional view of the actuator and an up-stop seal assembly of the present invention.
Figure 5A:
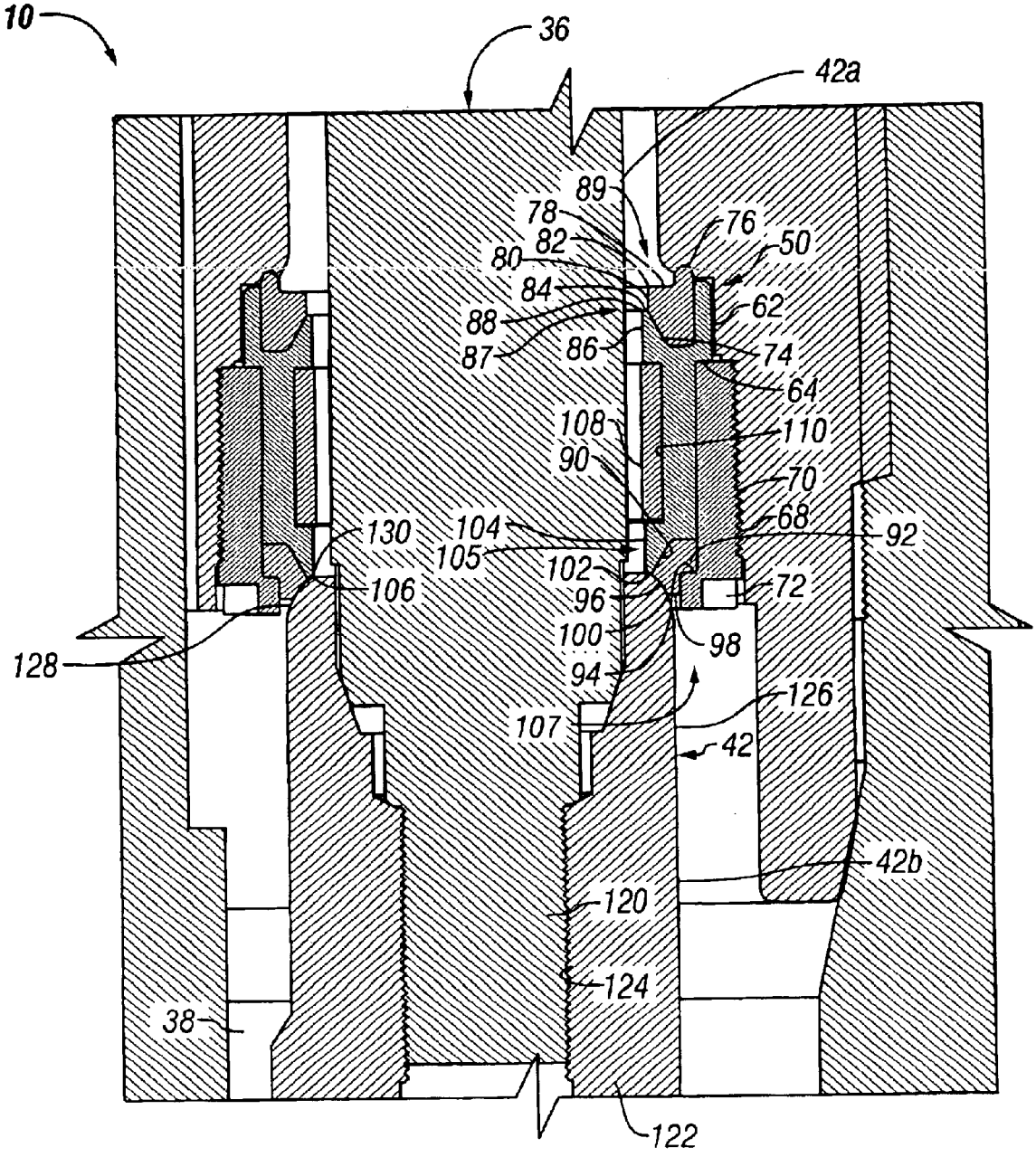
FIG. 5*a* is a partial schematic view similar to FIG. 5, where the actuator is shown in a fully engaged position with the up-stop assembly.

FIG. 5 is a partial schematic cross-sectional view of the actuator and an up-stop seal assembly of the present invention, where the actuator is shown in a partially engaged position at least one line contact surface. FIG. 5*a* is a partial schematic view similar to FIG. 5, where the actuator is shown in a fully engaged position with at least two line contact surfaces. FIGS. 5 and 5*a* will be described in conjunction with one another.

The up-stop seal assembly 107 has been described in reference to FIG. 4 and similar elements are similarly numbered. The up-stop seal assembly 107 operates in a similar fashion as the down-stop seal assembly 89 when the actuator contacts the seals in a raised upstroke position. Further details of at least one embodiment are described below.

The rod 42 can be divided into subparts. Separating the rod into multiple portions can assist in assembling and disassembling the actuator 36 in combination with the stop seal cartridge 50 and other members of the subsurface safety valve 10. For example, a first rod section 42*a* can be coupled to a second rod section 42*b*. The coupling can be accomplished in a number of ways. In one embodiment, the first rod section 42*a* can include a protrusion 120 and the second rod portion 42*b* can include a receiver portion 122. The portions can be fastened together in some manner, such as by threaded engagement, or in other manners as would be known to those with ordinary skill in the art.

In at least one embodiment, the second rod portion 42*b* has a first diameter 126. The first diameter 126 generally has a larger diameter than the inner wall 96 of the resilient seal 92, but less than the diameter of the chamber 38. The first diameter 126 transitions into a second engagement portion 128. In at least one embodiment, the second engagement portion 128 is generally a spherically-shaped section that ends at some reduced second diameter 130. The second diameter 130 is generally no greater than the diameter of the inner wall 96 of the housing 62 used to establish one of the annular line contact surfaces and generally is less than that dimension.

The up-stop seal assembly 107 with the annular line contact surfaces 100, 106 of the housing 62 is similar to the arrangement described in reference to the down-stop seal assembly 89 in FIG. 4. The second engagement portion 128 interfaces with the line contact surfaces 100, 106. The second engagement portion 128 is generally dimensioned to contact the line contact surface 100 first as the actuator 36 is raised in the chamber 38. As the actuator 36 continues to be raised, the resilient seal 92 and associated resilient annular line contact surface 100 is compressed. The actuator 36 engages the second line contact surface 106 at the upward end of the actuator 36 upstroke in the chamber 38 and stops. Advantageously, the spherical second engagement portion 128 contacts both line contact surfaces 100, 106 at the end of the actuator upstroke.

The up-stop assembly 107 helps ensure that debris, production fluids, and other material entering chamber 38 does not travel to the upper portion of the chamber 38 where the piston 40 and its various seals are positioned. Thus, the down-stop seal assembly 89 and up-stop seal assembly 107 can be advantageously disposed between the piston and the opening to the borehole 14 that would otherwise allow unwanted fluids into the area of the piston 40.

Referring to FIG. 2 in conjunction with FIG. 5, the operation of the actuator 36 in conjunction with the up-stop seal assembly 107 is illustrated. When the flow tube 26 is raised, for example by the bias member 28, and the actuator 36 is raised in an upstroke, the flapper 18 is allowed to resume a restricting orientation in the borehole 14. The actuator 36 is then in a static up position. The up-stop seal assembly 107 can be positioned so that the second engagement portion 128 of the actuator 36 in the up position engages the up-stop seal assembly 107. The combination of the second engagement portion 128, advantageously having a spherical shape in at least one embodiment, and one or more of the line contact surfaces 100, 106, alone or in combination, allow for some misalignment while effectively maintaining a continuous seal about the periphery of the actuator 36.

To gain access to the stop seal cartridge 50 from an assembled subsurface safety valve, the tubular body 12 can be disassembled into multiple components. In at least one embodiment, the tubular body 12 can be disassembled so that the chamber 38 is exposed. The second rod portion 42*b* can be disassembled from the flow tube 26. The second rod portion 42*b* can be disassembled from the first rod portion 42*a* and removed. The subhousing 68 can be removed, such as by unscrewing the subhousing from the tubular body 12. The resilient seal 92 can be removed from the housing 62, the housing 62 can be removed from the tubular body 12, and the resilient seal 76 can be removed from the housing 62. The centralizer bushing 108 can also be removed from the housing 62. The rest of the actuator, including the first rod portion 42*a* and the piston 40, can be removed from the chamber 38. Reassembly can be accomplished in reverse order.

Figure 6:
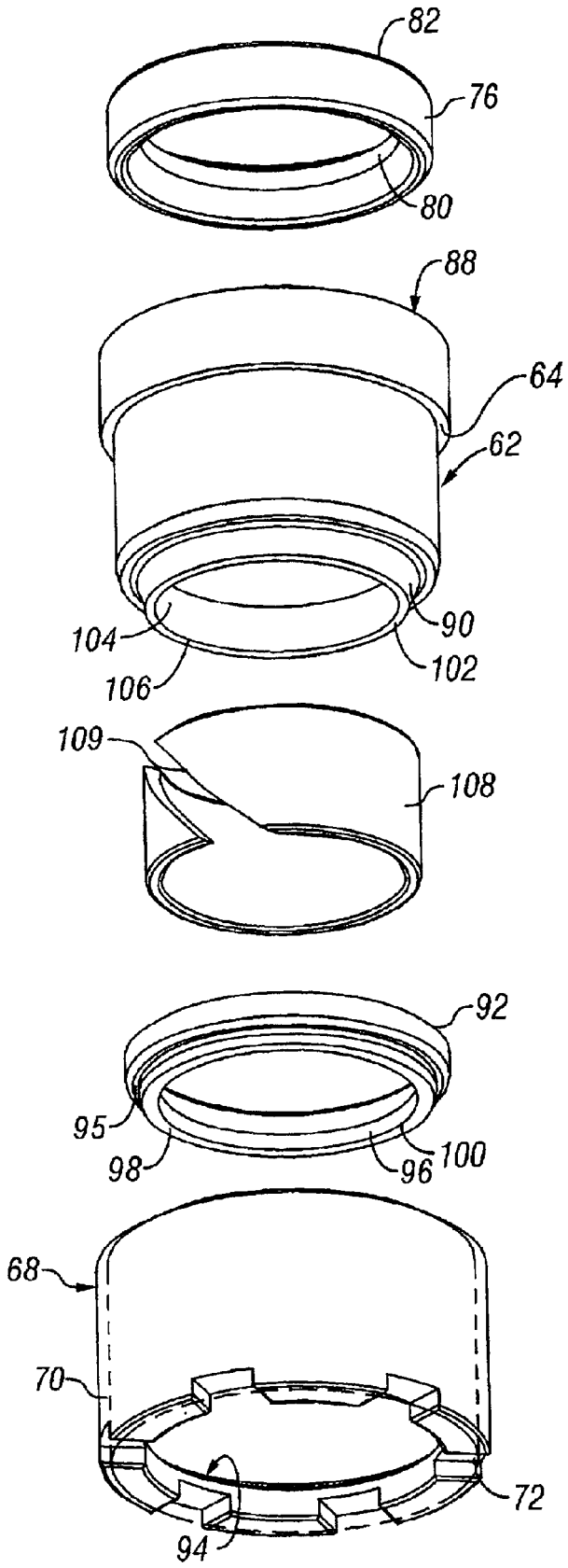
FIG. 6 is a schematic exploded isometric view of a stop seal cartridge.

FIG. 6 is a schematic exploded isometric view of the stop seal cartridge 50. Similar elements are numbered similarly and the various elements have been described above. The elements are shown in a disassembled condition as discrete elements, and include a subhousing 68, a resilient seal 92, a centralizer bushing 108, a housing 62, and a resilient seal 76.

The subhousing 68 generally includes a fastener 70, such as a threaded portion. The fastener 70 is used to engage the subhousing with the tubular body 12 or a subpart thereof. The rotation member 72 can be formed or otherwise coupled to the subhousing 68 to assist in rotating the subhousing into an assembled or disassembled state with the tubular housing 12 or subpart thereof. A shoulder 94 formed in the subhousing is beneath the line in the view of FIG. 5. The shoulder 94 is used to secure the resilient seal 92 to the housing 62 by engaging a corresponding shoulder 95 on the resilient seal 92, described in reference to FIGS. 4 and 5.

The resilient seal 92 includes an inner wall 96 and a shoulder 98. The intersection of the inner wall 96 and shoulder 98 forms an annular line contact surface 100. The spherical second engagement portion 114 of the actuator 36 shown in FIG. 5 can engage the line contact surface 100.

The centralizer bushing 108 is generally a cylindrical bushing which can be made of a number of materials that are generally softer and therefore more wearable compared to the rod 42 material which traverses through the centralizer bushing 108. In at least one embodiment, the centralizer bushing 108 is inserted into position within a recess (not shown) in the housing 62. To facilitate the insertion, a split 109 can be formed in the centralizer bushing 108. The split allows the outer circumference of the centralizer bushing 108 to be reduced when compressed. The bushing can then be inserted into the housing 62, positioned appropriately, and the compression released so that the bushing expands into that position. The assembled state of the centralizer bushing 108 or with housing 62 is shown in FIGS. 4 and 5 described herein.

A housing 62 can be used to locate or establish the seals with the annular contact surfaces. The housing can also be used to locate the centralizer bushing. The housing 62 generally includes a shoulder 64 to facilitate coupling the housing 62 into a tubular body 12 in conjunction with the subhousing 68, as shown in FIGS. 4 and 5. The housing 62 can also include an annular mounting surface 90 upon which the resilient seal 92 can be disposed. A portion of the housing 62 includes an inner wall 104 and a shoulder 102. The inner shoulder 102 and inner wall 104 effectively form a seal 105 establishing a second line contact surface 106. Generally, the housing 62 is formed from a non-resilient material, such as a metallic material. In an assembled condition, the line contact surface 100 from the resilient seal 92 and the non-resilient second line contact surface 106 from the housing 62 form a seal assembly for the rod.

Similarly, a seal assembly can be formed on the other end of the housing 62. A resilient seal 76 can include an annular line contact surface 82 formed from the intersection of an inner wall 80 and a shoulder, shown in FIGS. 4 and 5. The resilient seal 76 can be placed into a groove 74, also shown in FIGS. 4 and 5. A second line contact surface 88 is formed on an inside edge of the housing 62. The combination of the line contact surfaces 82, 88 form a seal assembly for the actuator 36, as described in reference to FIG. 4.

Figure 7:
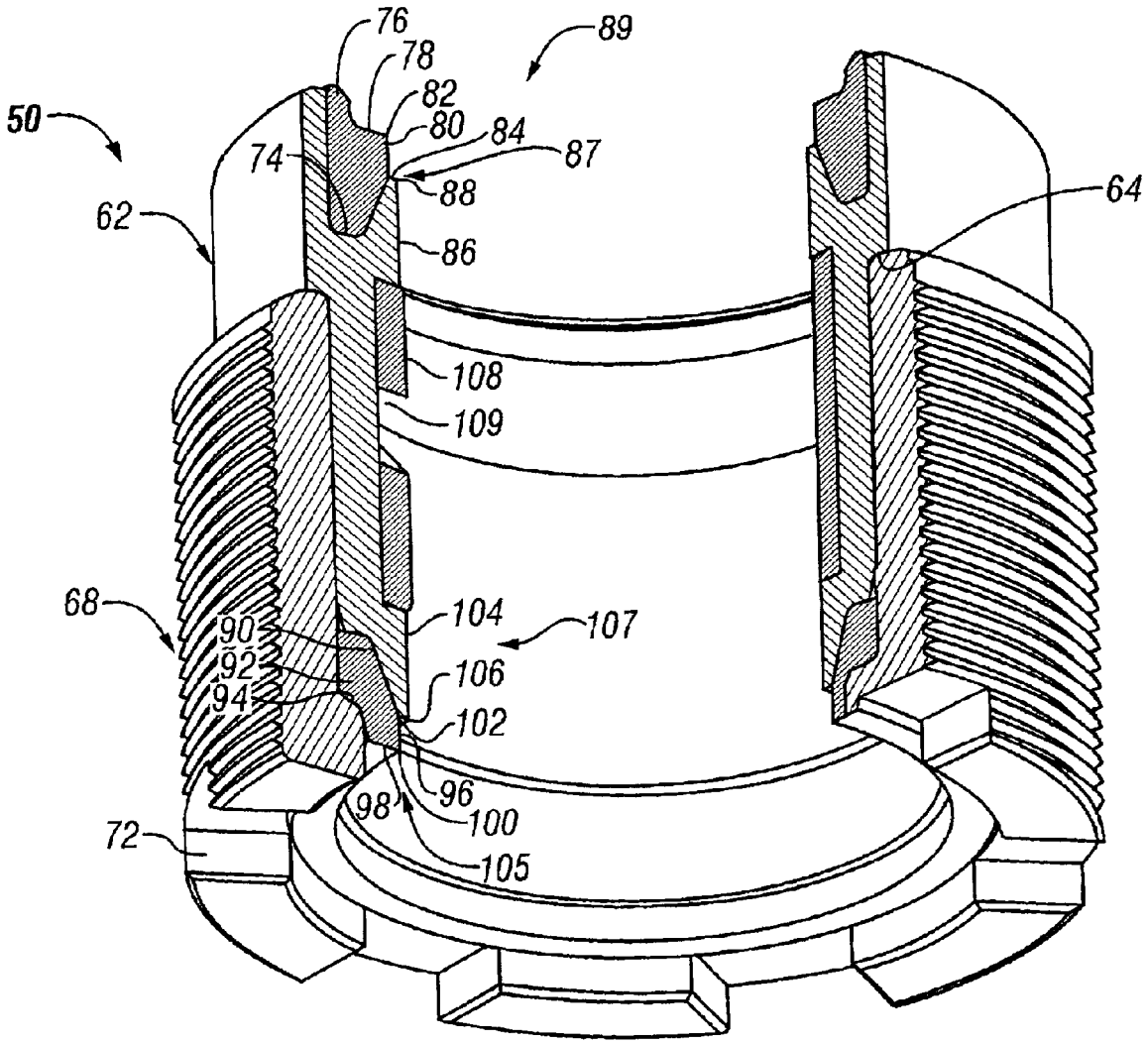
FIG. 7 is a schematic quarter section isometric view of the stop seal cartridge.

FIG. 7 is a schematic quarter section isometric view of the stop seal cartridge 50 in at least one embodiment. Similar elements described above are similarly numbered herein. The stop seal cartridge 50 includes a housing 62 and a subhousing 68. A shoulder 64 formed on the housing 62 can assist the subhousing 68 is retaining the housing 62 with the tubular body 12, shown in FIGS. 4–5*a*.

The housing 62 generally has a groove 74 formed therein into which a resilient seal 76 is disposed. The resilient seal 76 includes a shoulder 78 and an inner wall 80 that intersect to form a line contact surface 82. The resilient seal 76 is formed so that a portion of the actuator 36, such as a rod 42, having a first engagement portion 114 can engage the line contact surface 82 as shown in FIG. 4.

Further, the housing 62 can include a shoulder 84 and an inner wall 86 having a reduced diameter smaller than the diameter of the inner wall 80 of the resilient seal 76. The intersection of the shoulder 84 and inner wall 86 effectively forms a seal establishing a second line contact surface 88. Generally, the second line contact surface will be a non-resilient material that is harder than the resilient material of the line contact surface 82 of the resilient seal 76. The one or more line contact surfaces 82, 88 form the down-stop seal assembly 89.

In at least one embodiment, a corresponding structure can be formed on the other end of the stop seal cartridge 50. The housing 62 can include a mounting surface 90 upon which another resilient seal 92 is positioned. The subhousing 68 can include a shoulder 94 to engage the resilient seal 92 and hold the resilient seal in position, such as against the mounting surface 90. The resilient seal can include a shoulder 98 and an inner wall 96, where the intersection of each forms a line contact surface 100. Similarly, a shoulder 102 on the housing 62 and an inner wall 104 of the housing 62 can intersect to effectively form a seal establishing a second line contact surface 106. The one or more line contact surfaces 100, 106 form the up-stop assembly 107.

The order of the resilient seal member having a line contact surface and the non-resilient line contact surface formed by the housing 62 can be reversed so that the non-resilient line contact surface, such as 88, can be disposed above the resilient line contact surface 82. Similarly, on line contact surfaces 100, 106, the order can be reversed so that the non-resilient line contact surface 106 is disposed below the resilient line contact surface 100.

Generally, the engagement portions 114, 128 would diametrically first encounter the resilient line contact surfaces 82, 100 so that the resilient line contact surfaces will be displaced as the engagement portions contact the second line contact surfaces 88, 106, respectively.

The above teachings can apply to other types of subsurface valves, including without limitation, flow control valves. Flow control valves are well known in the art and generally have an outer sleeve which can cover inlet ports fluidically connected to a bore of the valve. The amount of coverage of the ports determines the amount of flow. For examples, as the sleeve progressively covers more of the ports, the flow is progressively restricted. The sleeve can be remotely actuated by an actuator disposed in a chamber and can encounter similar sealing challenges.

While the foregoing is directed to various embodiments of the present invention, other and further embodiments can be devised without departing from the basic scope thereof. For example, the various methods and embodiments of the invention can be included in combination with each other to produce variations of the disclosed methods and embodiments. Discussion of singular elements can include plural elements and vice-versa. Further, the use of any numeric quantities herein and particularly regarding the claims, such as "a", "the," or a plurality of elements includes at least such quantity. Any directions shown or described such as "top," "bottom," "left," "right," "upper," "lower," "down," "up" and other directions and orientations are described herein for clarity in reference to the figures and are not to be limiting of the actual device or system or use of the device or system. The device or system can be used in a number of directions and orientations. Further, the order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Additionally, any headings herein are for the convenience of the reader and are not intended to limit the scope of the invention. The use of the term as a singular item in conjunction and other similar terms is not limiting of the number of items Further, any references mentioned in the application for this patent as well as all references listed in the information disclosure originally filed with the application are hereby incorporated by reference in their entirety to the extent such may be deemed essential to support the enabling of the invention. However, to the extent statements might be considered inconsistent with the patenting of the invention, such statements are expressly not meant to be considered as made by the Applicant(s).

What is claimed is:

1. A subsurface safety valve system, comprising:

a) a tubular body having a borehole formed therethrough;

b) a valve member pivotably coupled to the tubular body to selectively close the borehole of the subsurface safety valve;

c) a tubular member at least partially disposed in the borehole and slidably coupled with the tubular body, the tubular member adapted to selectively displace the valve member in the borehole;

d) the safety valve further having a chamber formed therein with at least one chamber wall, the chamber coupled to the borehole;

e) an actuator slidably mounted within the chamber to establish a stroke and coupled to the tubular member in the borehole, the actuator having at least one spherical engagement portion; and f) a leading, annular, line contact surface disposed in the chamber, the line contact surface facing the at least one spherical actuator engagement portion and adapted to seat against the at least one spherical engagement portion at a selected portion of the actuator stroke.

2. The system of claim 1, wherein the at least one spherical engagement portion is formed from a first diameter of the actuator to a second diameter of the actuator.

3. The system of claim 1, further comprising a resilient line contact surface and a non-resilient line contact surface, wherein at least one of the line contact surfaces comprises the leading annular line contact surface.

4. The system of claim 3, further comprising a stop seal cartridge comprising the resilient and non-resilient line contact surfaces, the cartridge being mounted in the chamber.

5. The system of claim 3, wherein the actuator comprises two spherical engagement portions and further comprising at least one set of resilient and non-resilient line contact surfaces disposed in the chamber, each spherical engagement portion adapted to engage at least one of the line contact surfaces.

6. The system of claim 5, wherein each spherical engagement portion is adapted to engage both a resilient and non-resilient line contact surface.

7. The system of claim 3, further comprising a stop seal cartridge having at least one set of resilient and non-resilient line contact surfaces, the stop seal cartridge being removably coupled in the chamber.

8. The system of claim 1, further comprising a centralizer bushing mounted in the chamber and annularly disposed about the actuator.

9. The system of claim 1, wherein the actuator further comprises a piston and a seal annularly disposed about the piston.

10. The system of claim 9, further comprising a thrust ring annularly disposed about the piston.

11. A subsurface safety valve system, comprising:

a) tubular body having a borehole formed therethrough;

b) valve member pivotably coupled to the tubular body to selectively close the borehole of the subsurface safety valve;

c) tubular member at least partially disposed in the borehole and slidably coupled with the tubular body, the tubular member adapted to selectively displace the valve member in the borehole;

d) the safety valve further having a chamber formed therein with at least one chamber wall, the chamber coupled to the borehole;

e) an annular line contact surface disposed in the chamber; and f) an actuator slidably mounted within the chamber to establish a stroke and coupled to the tubular member in the borehole, the actuator having a spherical engagement portion adapted to seat against the annular line contact surface at a predetermined position of the stroke.

12. The system of claim 11, wherein the annular line contact surface comprises a leading, annular, line contact surface facing the spherical engagement portion.

13. The system of claim 11, further comprising a resilient line contact surface and a non-resilient line contact surface.

14. The system of claim 13, wherein the spherical line contact surface is dimensioned to engage both the resilient and the non-resilient line contact surfaces.

15. The system of claim 14, further comprising two spherical engagement portions and two annular line contact surfaces, wherein one spherical contact surface is adapted to contact one of the line contact surfaces on a downstroke of the actuator and the other spherical contact surface is adapted to contact the other of the line contact surfaces on an upstroke of the actuator.

16. The system of claim 15, further comprising a set of resilient and non-resilient seals for each of the spherical engagement portions.

17. The system of claim 16, wherein both sets of seals are mounted in a stop seal cartridge removably disposed in the chamber.

18. The system of claim 11, wherein the actuator further comprises a piston and a seal disposed annularly around the piston.

19. A subsurface safety valve system, comprising:

a) a tubular body having a borehole formed therethrough;

b) a valve member pivotably coupled to the tubular body to selectively close the borehole of the subsurface safety valve;

c) a tubular member at least partially disposed in the borehole and slidably coupled with the tubular body, the tubular member adapted to selectively displace the valve member in the borehole;

d) the safety valve further having a chamber formed therein with at least one chamber wall, the chamber coupled to the borehole;

e) a two annular line contact surfaces disposed in the chamber; and f) an actuator slidably mounted within the chamber to establish a stroke and coupled to the tubular member in the borehole, the actuator having an at least one spherical engagement portion adapted to seat against both of the annular line contact surfaces at a predetermined position of the stroke.

20. The system of claim 19, wherein one of the annular line contact surfaces comprises a resilient line contact surface and the other contact surface comprises a non-resilient line contact surface.

21. The system of claim 19, wherein at least one of the annular line contact surfaces comprises a leading line contact surface facing in the direction of the engagement portion that is adapted to engage the surfaces.

22. The system of claim 19, wherein the actuator comprises two spherical engagement portions and further comprising two sets of annular line contact surfaces disposed in the chamber, each having at least two line contact surfaces, each spherical engagement portion engaging at least one of the line contact surfaces of the respective set.

23. The system of claim 21, wherein each spherical engagement portions engages both line contact surfaces of the respective set.

24. The system of claim 19, wherein the line contact surfaces are disposed in a stop seal cartridge removably coupled to the chamber.

25. A subsurface safety valve system, comprising:

a) a tubular body having a borehole formed therethrough;

b) a valve member pivotably coupled to the tubular body to selectively close the borehole of the subsurface safety valve;

c) a tubular member at least partially disposed in the borehole and slidably coupled with the tubular body, the tubular member adapted to selectively displace the valve member in the borehole;

d) the safety valve further having a chamber formed therein with at least one chamber wall, the chamber coupled to the borehole;

e) two annular line contact surfaces disposed in the chamber; and f) an actuator slidably mounted within the chamber to establish a stroke and coupled to the tubular member in the borehole, the actuator having a spherical engagement portion adapted to seat against both of the annular line contact surfaces at a predetermined position of the stroke.

26. The system of claim 25, wherein at least one of the line contact surfaces comprises a leading line contact surface facing the spherical engagement portion that is adapted to engage the leading line contact surface.

27. The system of claim 25, wherein one of the annular line contact surfaces comprises a resilient line contact surface and the other contact surface comprises a non-resilient line contact surface.

28. The system of claim 25, wherein the actuator comprises two spherical engagement portions, each engaging a set of annular line contact surfaces.

29. The system of claim 25, wherein the line contact surfaces are disposed in a stop seal cartridge removably coupled to the chamber.

30. A subsurface safety valve system, comprising:

a) a tubular body having a borehole formed therethrough;

b) a valve member pivotably coupled to the tubular body to selectively close the borehole of the subsurface safety valve;

c) a tubular member at least partially disposed in the borehole and slidably coupled with the tubular body, the tubular member adapted to selectively displace the valve member in the borehole;

d) the safety valve further having a chamber formed therein with at least one chamber wall, the chamber coupled to the borehole;

e) an actuator slidably mounted within the chamber to establish a stroke and coupled to the tubular member in the borehole, the actuator having an at least one spherical engagement portion; and f) an annular stop seal cartridge removably coupled to the chamber, the stop seal cartridge comprising a resilient seal establishing an annular line contact surface and a non-resilient seal establishing a second annular line contact surface, the actuator being adapted to engage at least one of the line contact surfaces.

31. The system of claim 30, wherein the cartridge comprises a down-stop seal assembly and an up-stop seal assembly, wherein at least one of the assemblies comprises the resilient and non-resilient seals.

32. The system of claim 31, wherein each seal assembly comprises a resilient and non-resilient seal.

33. The system of claim 30, wherein at least one of the line contact surfaces comprises a leading line contact surface facing the engagement portion that is adapted to engage the leading line contact surface.

34. The system of claim 30, wherein the at least one spherical engagement portion is formed between a first cross sectional area of the actuator to a reduced second cross sectional area of the actuator and adapted to engage both line contact surfaces.

35. The system of claim 34, wherein the resilient seal and non-resilient seal are disposed relative to each other so that the spherical engagement portion first contacts the resilient seal.

36. The system of claim 31, wherein the actuator comprises two spherical engagement portions, each spherical engagement portion being formed from a first cross sectional area of the actuator to a reduced second cross sectional area of the actuator and the spherical engagement portions being spaced about a distance corresponding to the stroke of the actuator.

37. The system of claim 36, wherein one spherical engagement portion is adapted to engage the down-stop seal assembly at one position of the stroke and the other spherical engagement portion is adapted to engage the up-stop seal assembly at another position of the stroke.

38. A method of sealing a subsurface safety valve system, comprising:

a) providing a subsurface safety valve having a tubular body with a borehole formed therethrough and a valve element pivotably coupled to the tubular body to selectively close the borehole;

b) allowing the valve element to be pivoted open by actuating a tubular member coupled to the valve element with an actuator slidably mounted in an adjacent chamber, the actuator comprising at least one spherical engagement portion; and c) statically sealing the actuator against a leading, annular, line contact surface facing the actuator engagement portion.

39. The method of claim 38, wherein statically sealing the actuator comprises engaging the at least one spherical engagement portion against the leading, annular, line contact surface.

40. The method of claim 39, wherein statically sealing the actuator further comprises sealing against a resilient seal and a non-resilient seal with the at least one spherical engagement portion, wherein at least one of the seals comprises the leading, annular, line contact surface.

41. The method of claim 38, wherein statically sealing the actuator further comprises sealing at a downward stroke of the actuator against the leading, annular, line contact surface and sealing at an upward stroke of the actuator against another leading, annular, line contact surface.

42. The method of claim 41, wherein the actuator comprises two spherical engagement portions and wherein statically sealing the actuator further comprises sealing the actuator on a downstroke of the actuator with one of the spherical engagement portions engaging both a resilient seal and a non-resilient seal wherein at least one of the seals establishes a first leading annular line contact surface and further sealing the actuator on an upstroke of the actuator with the other spherical engagement portion engaging both a second resilient seal and a second non-resilient seal wherein at least one of the second seals establishes a second leading line contact surface.

43. A method of sealing a subsurface safety valve, comprising:

a) providing a subsurface safety valve having a tubular body with a borehole formed therethrough and a valve element pivotably coupled to the tubular body to selectively close the borehole;

b) allowing the valve element to be pivoted open by actuating a tubular member coupled to the valve element with an actuator slidably mounted in an adjacent chamber; and c) statically sealing the actuator with a spherical engagement portion against an annular line contact surface.

44. The method of claim 43, wherein the annular line contact surface comprises a leading, annular, line contact surface facing the spherical engagement portion and wherein statically sealing the actuator comprises engaging the spherical engagement portion against the leading, annular, line contact surface.

45. The method of claim 43, wherein statically sealing the actuator comprises sealing against a resilient seal and a non-resilient seal, wherein each of the seals establishes an annular line contact surface.

46. The method of claim 45, wherein sealing against the resilient seal and the non-resilient seal comprises sealing against at least one leading, annular, line contact surface.

47. The method of claim 43, wherein sealing the actuator comprises sealing at a downward stroke of the actuator and sealing at an upward stroke of the actuator in the chamber.

48. The method of claim 47, wherein the actuator comprises two spherical engagement portions and wherein statically sealing the actuator further comprises sealing the actuator on a downstroke of the actuator with one of the spherical engagement portions engaging both a resilient seal and a non-resilient seal wherein at least one of the seals establishes a first leading annular line contact surface and further sealing the actuator on an upstroke of the actuator with the other spherical engagement portion engaging both a second resilient seal and a second non-resilient seal wherein at least one of the second seals establishes a second leading line contact surface.

49. A method of sealing a subsurface safety valve, comprising:

a) providing a subsurface safety valve having a tubular body with a borehole formed therethrough and a valve element pivotably coupled to the tubular body to selectively close the borehole;

b) allowing the valve element to be pivoted open by actuating a tubular member coupled to the valve element with an actuator slidably mounted in an adjacent chamber; and c) statically sealing a spherical engagement portion on the actuator against two annular line contact surfaces.

50. The method of claim 49, wherein statically sealing the actuator comprises sealing with the spherical engagement portion against both annular line contact surfaces at a portion of a stroke of the actuator.

51. The method of claim 50, wherein statically sealing the actuator comprises sealing against a resilient seal establishing one of the line contact surfaces and sealing against a non-resilient seal establishing another of the annular line contact surfaces.

52. The method of claim 49, wherein statically sealing the actuator comprises sealing against a leading, annular, line contact surface facing an engagement portion of the actuator.

53. The method of claim 49, wherein statically sealing the actuator comprises sealing against the two line contact surfaces on a downstroke of the actuator.

54. The method of claim 49, wherein statically sealing the actuator comprises sealing against the two line contact surfaces on an upstroke of the actuator.

55. The method of claim 49, wherein the actuator comprises two spherical engagement portions and wherein statically sealing the actuator further comprises sealing the actuator on a downstroke of the actuator with one of the spherical engagement portions engaging both a resilient seal and a non-resilient seal wherein at least one of the seals establishes one of the annular line contact surfaces and further sealing the actuator on an upstroke of the actuator with the other spherical engagement portion engaging both a second resilient seal and a second non-resilient seal wherein at least one of the second seals establishes another of the annular line contact surfaces.

56. A subsurface safety valve system, comprising:

a) a tubular body having a borehole formed therethrough;

b) a valve member pivotably coupled to the tubular body to selectively close the borehole of the subsurface safety valve;

c) a tubular member at least partially disposed in the borehole and slidably coupled with the tubular body, the tubular member adapted to selectively displace the valve member in the borehole;

d) the safety valve further having a chamber formed therein with at least one chamber wall, the chamber coupled to the borehole, the chamber having at least one fluid port for coupling to a fluid source;

e) an annular line contact surface disposed in the chamber;

f) an actuator slidably mounted within the chamber to establish a stroke and coupled to the tubular member in the borehole, the actuator having a spherical engagement portion adapted to seat against the annular line contact surface at a predetermined position of the stroke and a piston;

g) one or more seals coupled to the piston and disposed at least partially between the piston and the chamber wall; and h) a bearing coupled to the actuator and slidable with the actuator in the chamber, the bearing disposed at least partially between the actuator and the chamber wall and between one or more of the seals and the fluid port to at least partially protect the one or more of the seals from contaminants.

57. The system of claim 56, further comprising a seal retainer disposed adjacent one or more of the seals and coupled to the actuator.

58. The system of claim 57, wherein the bearing is at least partially disposed between the seal retainer and the chamber wall.

59. The system of claim 56, further comprising an annular stop seal cartridge removably coupled to the chamber, the stop seal cartridge comprising a resilient seal establishing an annular line contact surface and a non-resilient seal establishing a second annular line contact surface, the actuator being adapted to engage at least one of the line contact surfaces.

60. The system of claim 59, wherein the cartridge comprises a down-stop seal assembly and an up-stop seal assembly, wherein at least one of the assemblies comprises the resilient and non-resilient seals.

61. A subsurface valve sealing system, the subsurface valve including a tubular body with a borehole formed therethrough, a tubular member slidably coupled with the tubular body, a chamber formed in the tubular body and having at least one chamber wall, the chamber coupled to the borehole and having at least one fluid port for connecting to a fluid source, and an actuator slidably mounted within the chamber to establish a stroke and coupled to the tubular member in the borehole, the actuator having an engagement portion, the system comprising:

an annular stop seal cartridge removably coupled to the chamber, the stop seal cartridge comprising a resilient seal establishing an annular line contact surface and a non-resilient seal establishing a second annular line contact surface, the stop seal cartridge adapted to be engaged with the actuator spherical engagement portion at least one of the line contact surfaces.

62. The system of claim 61, wherein at least one of the line contact surfaces comprises a leading line contact surface facing the actuator engagement portion.

63. The system of claim 61, wherein the adaptor engagement portion has a spherically shaped surface and wherein both line contact surfaces are adapted to be engaged by the spherical engagement portion.

64. The system of claim 63, wherein the resilient seal and non-resilient seal are disposed relative to each other so that the spherical engagement portion first contacts the resilient seal.

65. The system of claim 61, wherein the cartridge comprises a down-stop seal assembly and an up-stop seal assembly, wherein at least one of the assemblies comprises the resilient and non-resilient seals.

66. The system of claim 65, wherein each seal assembly comprises a resilient and a non-resilient seal.

67. The system of claim 65, wherein the actuator includes two spherical engagement portions spaced about a distance corresponding to the stroke of the actuator and wherein the down-stop assembly is adapted to be engaged by one of the spherical engagement portions and the up-stop assembly is adapted to be engaged by another of the spherical engagement portions.

68. The system of claim 61, wherein the further comprising one or more seals coupled to the piston and disposed at least partially between the piston and the chamber wall and a bearing coupled to the actuator and slidable with the actuator and disposed at least partially between the actuator and the chamber wall and between one or more of the seals and the fluid port.

69. The system of claim 61, further comprising a seal retainer disposed adjacent one or more of the seals and coupled to the actuator.

70. The system of claim 69, wherein a bearing is disposed at least partially between the seal retainer and the chamber wall.

71. A method of sealing a subsurface safety valve, comprising:

a) providing a subsurface safety valve having a tubular body with a borehole formed therethrough and a valve element pivotably coupled to the tubular body to selectively close the borehole;

b) allowing the valve element to be pivoted open by actuating a tubular member coupled to the valve element with an actuator slidably mounted in an adjacent chamber and having an engagement portion;

c) at least partially sealing a portion of the actuator against a chamber wall with one or more seals coupled to the actuator and disposed around the actuator; and d) restricting a flow of contaminants from a fluid source to one or more of the seals as the actuator moves in the chamber by providing a bearing slidably coupled with the actuator in the chamber and disposed between the fluid source and one or more of the seals to at least partially protect the one or more of the seals from contaminants.

72. The method of claim 71, further comprising sealing the actuator in at least one position in the stroke with an annular stop seal cartridge removably coupled to the chamber, the cartridge having one or more annular line contact surfaces.

73. The method of claim 72, wherein sealing the actuator comprises sealing with one or more leading line contact surfaces facing the engagement portion of the actuator.

74. A seal system for use with an actuator of a downhole tool, the actuator having at least one spherical engagement surface formed thereon, the seal system comprising:

a) a first sealing member having an annular line contact surface formed thereon, the annular line contact surface adapted to mate with the at least one spherical engagement surface at a predetermined point during the stroke of the actuator; and b) a second sealing member having an annular line contact surface formed thereon, the annular line contact surface adapted to mate with the at least one spherical engagement surface at a second predetermined point during the stroke of the actuator.

75. A safety valve for use in a wellbore, the safety valve comprising:

a) a body having a bore formed therethrough;

b) a member pivotably coupled to the body to selectively close the bore;

c) a tubular slidably coupled with the body, the tubular adapted to selectively displace the member in the bore;

d) a chamber coupled to the bore, the chamber having an annular line contact surface; and f) an actuator slidably mounted within the chamber to establish a stroke, the actuator having at least one spherical engagement surface adapted to seat against the annular line contact surface at a predetermined position of the stroke, the actuator coupled to the tubular in the bore.

* * * * *

UNITED STATES PATENT AND TRADEMARK OFFICE

CERTIFICATE OF CORRECTION

PATENT NO. : 6,854,519 B2 
DATED : February 15, 2005
INVENTOR(S) : Thomas Michael Deaton et al.

It is certified that error appears in the above-identified patent and that said Letters Patent is hereby corrected as shown below:

Column 20,
Line 29, remove "50" and replace with -- 49 --.

Signed and Sealed this

Twenty-fourth Day of May, 2005

JON W. DUDAS
*Director of the United States Patent and Trademark Office*